US009539632B2

(12) United States Patent
Graff

(10) Patent No.: US 9,539,632 B2
(45) Date of Patent: Jan. 10, 2017

(54) ULTRASONIC EXCITATION OF SEGMENTED DIES

(71) Applicant: Karl Graff, Columbus, OH (US)

(72) Inventor: Karl Graff, Columbus, OH (US)

(73) Assignee: EDISON WELDING INSTITUTE, INC., Columbus, OH (US)

( * ) Notice: Subject to any disclaimer, the term of this patent is extended or adjusted under 35 U.S.C. 154(b) by 0 days.

(21) Appl. No.: 14/802,386

(22) Filed: Jul. 17, 2015

(65) Prior Publication Data

US 2016/0016219 A1 Jan. 21, 2016

Related U.S. Application Data

(60) Provisional application No. 62/025,826, filed on Jul. 17, 2014.

(51) Int. Cl.

| | |
|---|---|
| ***B21D 22/02*** | (2006.01) |
| ***B21D 37/20*** | (2006.01) |
| *B21D 35/00* | (2006.01) |

(52) U.S. Cl.

CPC ..... *B21D 22/02* (2013.01); *B21D 37/20* (2013.01); *B21D 35/008* (2013.01)

(58) Field of Classification Search

CPC ..... B21D 22/02; B21D 37/20; B21D 35/008

USPC ..... 72/478

See application file for complete search history.

(56) References Cited

U.S. PATENT DOCUMENTS

| | | | | |
|---|---|---|---|---|
| 6,862,913 | B2 * | 3/2005 | Lempenauer | B21D 39/031 29/715 |
| 2014/0208964 | A1 * | 7/2014 | Kohno | B23Q 5/033 100/35 |
| 2015/0298195 | A1 * | 10/2015 | Jurich | B21D 22/20 72/347 |

* cited by examiner

*Primary Examiner* — David B Jones

(74) *Attorney, Agent, or Firm* — McNees Wallace & Nurick LLC

(57) ABSTRACT

A method for reducing areas of friction within a forming die that includes identifying at least one region of interest in the forming die, wherein the at least one region of interest further includes a problematic aspect of a predetermined nature; designing a die segment corresponding to the at least one region of interest, wherein the die segment further includes at least one ultrasonic transducer embedded therein; modifying the forming die to receive the die segment; installing the die segment in the forming die and acoustically isolating the die segment from the remainder of the forming die; and energizing the ultrasonic transducer to provide ultrasonic energy to the die segment, wherein providing ultrasonic energy to the die segment addresses the problematic aspect of the at least one region of interest in the forming die.

9 Claims, 5 Drawing Sheets

ULTRASONIC EXCITATION OF SEGMENTED DIES

CROSS-REFERENCE TO RELATED APPLICATIONS

This patent application claims the benefit of U.S. Provisional Patent Application Ser. No. 62/025,826 filed on Jul. 17, 2014 and entitled "Ultrasonic Excitation of Segmented Dies", the disclosure of which is hereby incorporated by reference herein in its entirety and made part of the present U.S. utility patent application for all purposes.

BACKGROUND OF THE INVENTION

The described invention relates in general to manufacturing systems and methods and more specifically to a system and method for applying ultrasonic excitation to segmented dies used in manufacturing processes such as those used in the automotive industry.

The potential of using ultrasonic vibrations to reduce friction during sheet metal forming processes, e.g. in deep drawing, has been recognized and investigated over the years, with favorable results having been reported, both in forming processes, and in the fundamental mechanics of friction reduction. One sheet metal forming area where ultrasonic friction reduction would presumably have a major benefit is in the forming/stamping of auto body parts. In this field, new challenges are continually emerging as efforts are made to form higher strength steel and aluminum alloys having complex shapes. However, in forming and stamping of auto body parts and the like, large steel dies, blank holders and punches are used, not uncommonly having weights in excess of several thousand kilograms and lateral dimensions on orders of meters and of significant thicknesses. Unfortunately, achieving ultrasonic excitation of such large masses is beyond the current capabilities of high power ultrasonic systems and would seemingly rule out this field of application. Furthermore, current industry methods for friction alleviation typically involve the application of coatings to a die surface, which has the disadvantages of (i) requiring renewal as it wears away with repeated stampings; (ii) leaving residues on the stamped sheet metal surfaces which must be later removed; and (iii) the subsequent disposal of those residues.

However, three primary factors suggest that there are significant applications for high power ultrasonics (HPU) in the forming of auto body parts and the like. First, in the stamping of auto parts, it has been observed that only certain critical areas of a die are unusually challenging to the forming operation. Thus, while a die may indeed be of large size and mass, only a comparatively small region might have a form or shape factor that may compromise die performance. Accordingly, the amount of die volume/mass associated with a problem region could be within a range that could be feasibly vibrated by ultrasonic vibrations, provided that region could be acoustically isolated from the remaining die mass. Secondly, it is current practice to segment portions of a die for various purposes, but most notably to permit repair or replacement of high wear regions. Although it would seem that the boundaries of the segmented regions would be susceptible to causing marking of the stamped parts, the stamping process is actually fairly tolerant of die surface details insofar as part markings Thirdly, through prior work on ultrasonic friction reduction, processes have been developed for acoustically isolating and securing ultrasonically excited blocks that are believed able to find application to the present issue of both ultrasonically vibrating a die segment and securing it within an overall die structure. Thus, there is an ongoing need for a system for applying ultrasonic excitation to segmented dies.

SUMMARY OF THE INVENTION

The following provides a summary of certain exemplary embodiments of the present invention. This summary is not an extensive overview and is not intended to identify key or critical aspects or elements of the present invention or to delineate its scope.

In accordance with one aspect of the present invention, a method for reducing areas of friction within a forming die is provided. This method includes the steps of identifying at least one region of interest in the forming die, wherein the at least one region of interest further includes a problematic aspect of a predetermined nature; designing a die segment corresponding to the at least one region of interest, wherein the die segment further includes at least one ultrasonic transducer embedded therein; modifying the forming die to receive the die segment that includes the at least one ultrasonic transducer; installing the die segment in the forming die and acoustically isolating the die segment from the remainder of the forming die; and energizing the at least one ultrasonic transducer to provide ultrasonic energy to the die segment, wherein providing ultrasonic energy to the die segment addresses the problematic aspect of the at least one region of interest in the forming die.

In accordance with another aspect of the present invention, a first forming die is provided. This forming die includes a body, wherein the body of the forming die includes at least one opening created therein; a die segment, wherein the die segment is adapted to be inserted into the opening in the body of the forming die, and wherein the die segment is further adapted to receive ultrasonic vibrations; and at least one source of ultrasonic vibrations in communication with the die segment for directing ultrasonic vibrations into the die segment.

In yet another aspect of this invention, a second forming die is provided. This forming die includes a body, wherein the body of the forming die includes at least one opening created therein; a die segment, wherein the die segment is adapted to be inserted into the opening in the body of the forming die, and wherein the die segment is further adapted to receive ultrasonic vibrations; at least one source of ultrasonic vibrations in communication with the die segment for directing ultrasonic vibrations into the die segment; and at least one vibration-isolating device positioned between the die segment and the body of the forming die, wherein the at least one vibration isolating device prevents ultrasonic vibrations from the die segment from entering the body of the forming die.

Additional features and aspects of the present invention will become apparent to those of ordinary skill in the art upon reading and understanding the following detailed description of the exemplary embodiments. As will be appreciated by the skilled artisan, further embodiments of the invention are possible without departing from the scope and spirit of the invention. Accordingly, the drawings and associated descriptions are to be regarded as illustrative and not restrictive in nature.

DESCRIPTION OF THE DRAWINGS

The accompanying drawings, which are incorporated into and form a part of the specification, schematically illustrate one or more exemplary embodiments of the invention and, together with the general description given above and detailed description given below, serve to explain the principles of the invention, and wherein:

FIGS. 2A-C illustrate various shapes that may be subject to vibration analysis wherein FIG. 2A is a 3D block, FIG. 2B is a thin plate, and FIG. 2C is a thin rod;

FIGS. 4A-B illustrate an acoustically resonant shape having an internal ultrasonic vibration source, wherein FIG. 4A depicts a 3D block with section AA marked thereon, and wherein FIG. 4B depicts section AA of the 3D block, and wherein the ultrasonic vibration source is visible therein;

FIGS. 6A-B depict alternate means for pre-compressing the piezoceramics included in an ultrasonic transducer, wherein FIG. 6A depicts the use of a center bolt for compression, and wherein FIG. 6B depicts pre-compression by means of tapered shims;

FIGS. 7A-B depict an ultrasonic die insert in a die structure, wherein FIG. 7A depicts a monolithic die with an ultrasonic die insert, and wherein FIG. 7B depicts the ultrasonic die insert removed from the die.

DETAILED DESCRIPTION OF THE INVENTION

Exemplary embodiments of the present invention are now described with reference to the Figures. Although the following detailed description contains many specifics for purposes of illustration, a person of ordinary skill in the art will appreciate that many variations and alterations to the following details are within the scope of the invention. Accordingly, the following embodiments of the invention are set forth without any loss of generality to, and without imposing limitations upon, the claimed invention.

The purpose of the present invention is to apply ultrasonic vibrations to one or more regions of a large stamping die in order to reduce friction between the sheet metal being formed and the surface of the die, thereby improving the formability of the metal at critical shape locations, as well as reducing galling, tearing and cracking of the sheet metal. This desired effect is accomplished by acoustically isolating a segment (or segments) of the die and embedding within the die, an ultrasonic vibration source (i.e., an ultrasonic transducer) that creates resonant vibrations of the die, of varying magnitudes, at its several surfaces thereby creating an ultrasonic friction reduction effect having various benefits. Thus, the present invention typically includes the steps of: (i) identifying a critical region (or regions) of a die where friction reduction would have greatest effect (or effects); (ii) acoustically isolating a segment (or segments) of the die, from the critical region (or regions) into a manageable mass (or masses) that is capable of being ultrasonically excited; and (iii) incorporating within that mass a source of ultrasonic excitation, i.e., an ultrasonic transducer system. The ultrasonic excitation of the die segment by an internal source versus transmitting vibrations from an external source to the die segment along with the specific means of its acoustic isolation, are among the novel features of the invention.

Figure 1A:
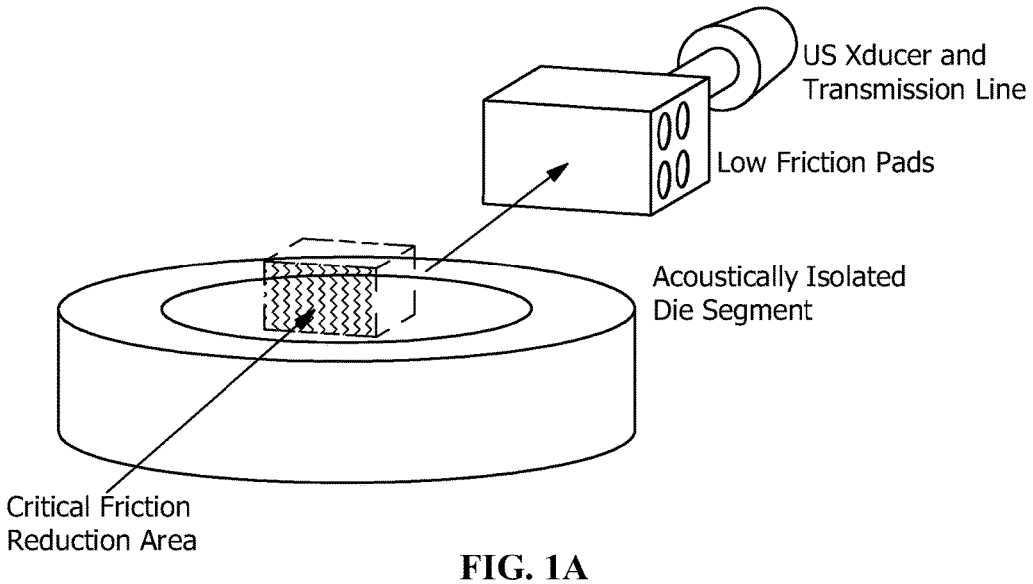
FIG. 1A depicts an acoustically isolated die segment and FIG. 1B depicts an acoustically isolate blank holder segment.
Figure 1B:
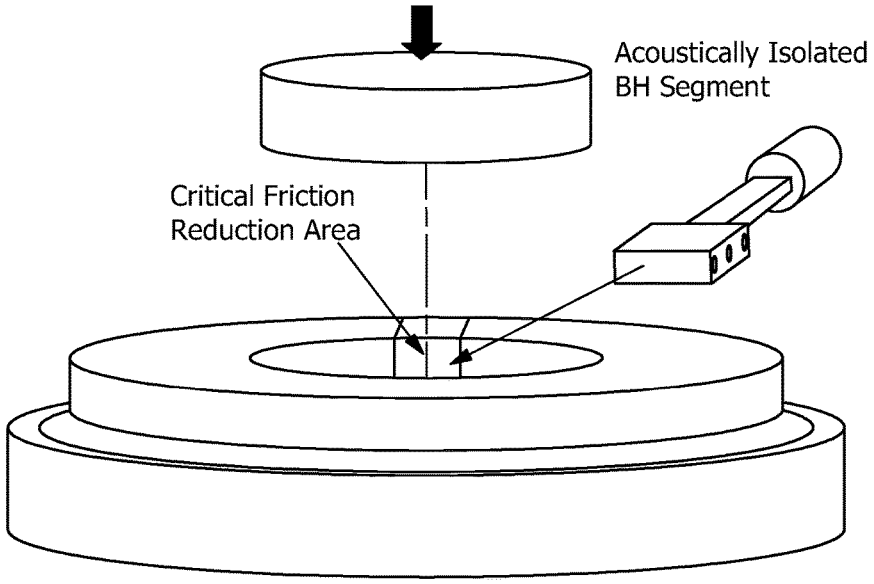

With reference now to the Figures, FIGS. 1A-B illustrate the application of ultrasonic vibration to a segmented die by external means, wherein FIG. 1A depicts an acoustically isolated die segment and wherein FIG. 1B depicts an acoustically isolated blank holder segment. These illustrations share two common features: (a) a segment of die is shown to be isolated, by means of low friction pads, from the balance of the die mass; and (b) ultrasonic vibration is transmitted to the die segment from an external transducer by means of an ultrasonic transmission line connection. Low friction pads are one, but not the only, means of acoustic die isolation. However, the requirement of an external means of both generating ultrasonic vibrations (the transducer) and a direct, robust mechanical connection between the transducer and a die segment (by a transmission line that may be several inches in length, e.g. at least 10 inches for systems operating at 20 kHz) can be a significant disadvantage to a die vibration technology dependent on such means. For this reason, the present invention replaces this means of die excitation with other means of die excitation.

Figure 2A:
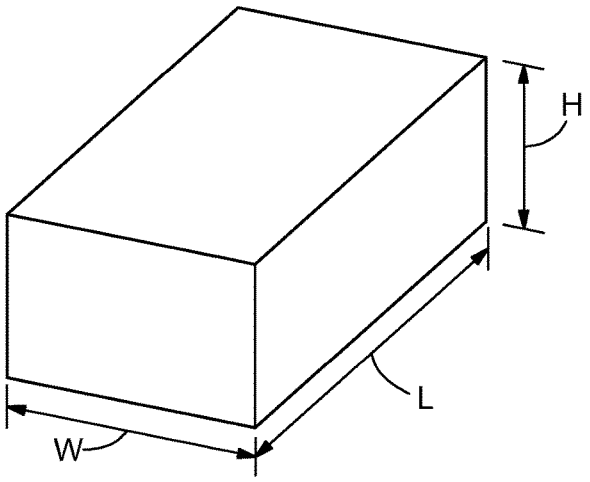
Figure 2B:
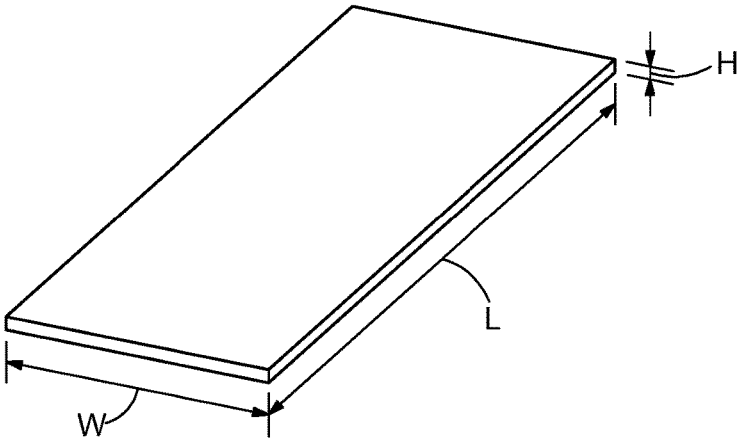
Figure 2C:
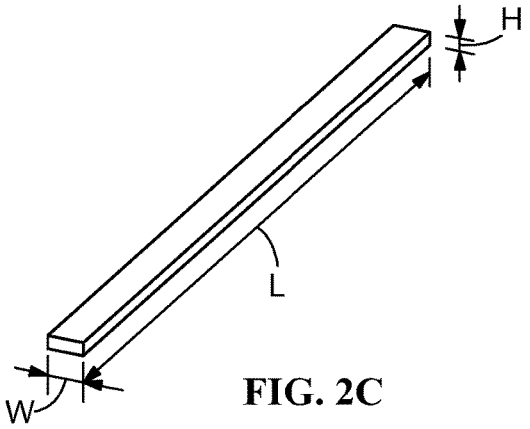

With regard to three-dimensional (3D) vibration, in general, a fundamental aspect of the present invention is that of creating ultrasonic resonant vibrations in a 3D mass of "arbitrary mass and shape." While all objects are 3D, in the present context it means that the general L, W and H dimensions of the object are of the same order of magnitude, i.e. $W \approx L \approx H$ as shown in FIG. 2A for the case of a rectangular block. For possible later reference, the cases of a thin plate, $W \approx L \gg H$ and a thin rod, $L \gg W, H$ are shown in FIGS. 2B-C. Determining the vibration characteristics of a 3D shape typically requires use of the equations of elasticity and FEA methods, whereas analysis of plate and rod shapes can often involve simpler governing equations and analysis methods. While the 3D block of FIG. 2A is not an "arbitrary shape" it is generally illustrative with regard to this invention.

Figure 3:
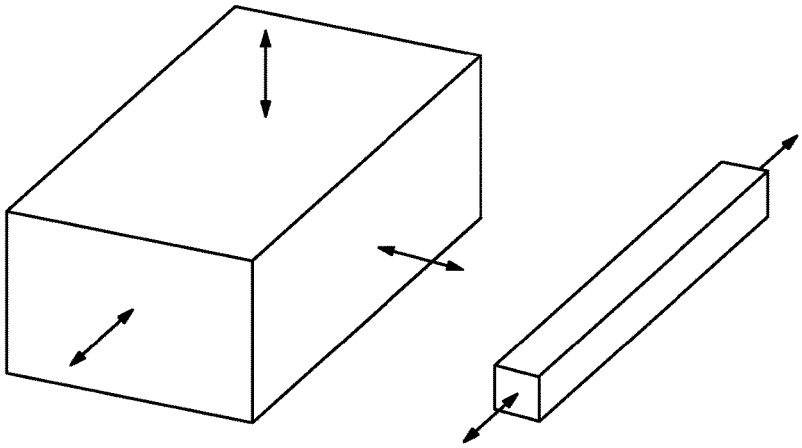
FIG. 3 illustrates three dimensional (left) and one dimensional (right) vibrational modes.
Figure 4A:
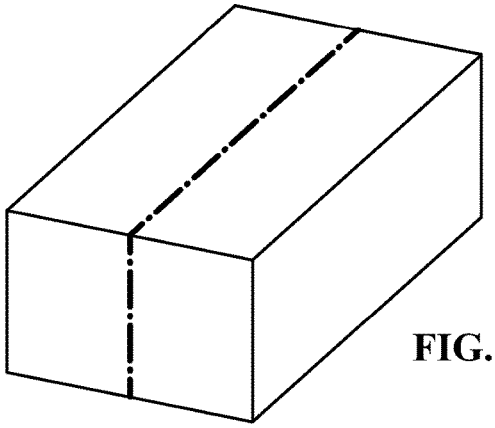
Figure 4B:
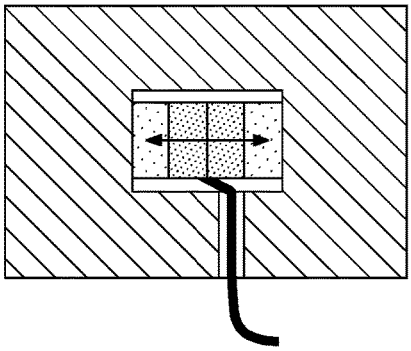

With regard to using a 3D vibrating die segment, in nearly all ultrasonic transducer and tooling developments, the effort is continually one of "one-dimensionalizing" the geometry in order to avoid energy absorbing 3D vibrational modes. Thus, it is desirable to confine the major vibration direction to a single dimension along a vibration axis, such as shown by the thin rod in the FIG. 2C. The present invention seeks to increase the lateral dimension to comparable sizes and to deliberately seek achieving a 3D vibrational situation, versus a 1D mode, as illustrated in FIG. 3. Thus, the 3D block is made into an ultrasonically vibrating, acoustically resonant shape by embedding, completely within the block, an ultrasonic vibration source that is connected to the external system simply by an electrical connection, and possibly an air cooling connection. A simplistic version this system is shown in FIGS. 4A-B, which provide perspective and cutaway views, respectively.

Figure 5:
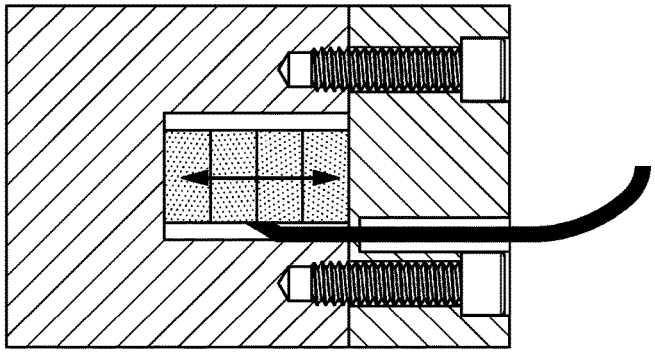
FIG. 5 depicts a bolted 3D resonant die, wherein an ultrasonic vibration source is visible therein.
Figure 6A:
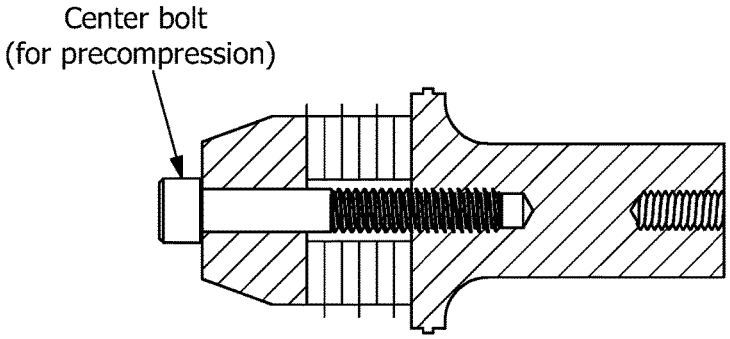
Figure 6B:
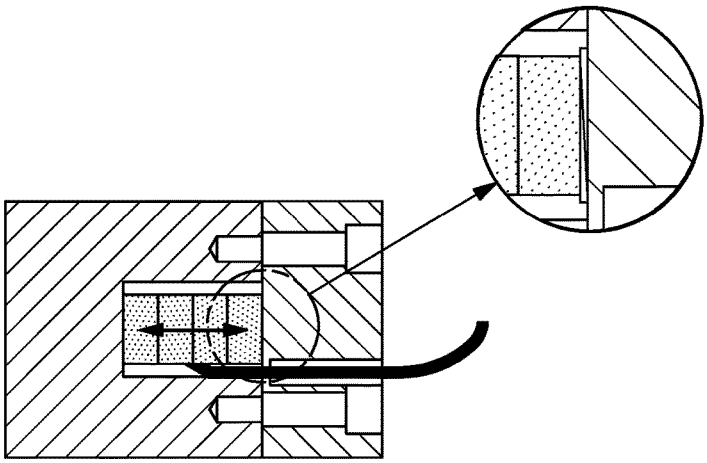

Embedding the vibration source within the block typically involves sectioning the block and FIG. 5 illustrates a bolted, sectioned arrangement. In FIG. 5, the electrical connection has been redirected to exit the end of the block. For use in the present invention, the piezoceramics in an ultrasonic transducer are pre-compressed to prevent tensile fracture. In standard transducers, this is usually accomplished by a compression bolt, as shown in FIG. 6A. However, the assembly method for the die may not allow for the careful control of precompression that the standard transducer construction provides and other means may be necessary. One such alternate means includes the use of tapered shims, as shown in FIG. 6B.

Maintaining the thickness of the block walls is important for exerting significant forces while undergoing vibration. Because of the 3D shape, and the varied shapes that may be used for different dies, the frequency spectrum of the die will likely be complex, possibly having a number of adjacent frequencies. Finite element analysis (FEA) may be used to arrive at an optimum frequency giving the desired vibration modes. This may not be at the usual "standard" 20 kHz, but may vary from case to case and may involve a more flexible power supply than currently used that is able to match to a wider range of frequencies.

Figure 7A:
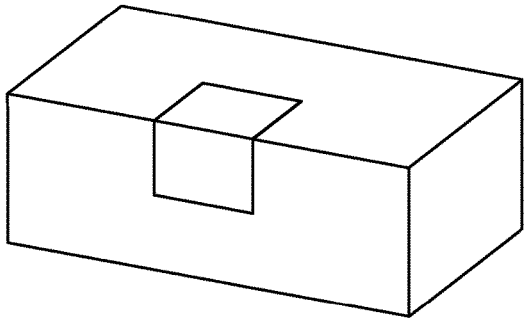
Figure 7B:
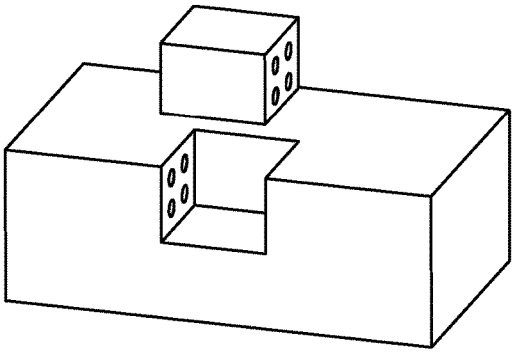
Figure 8:
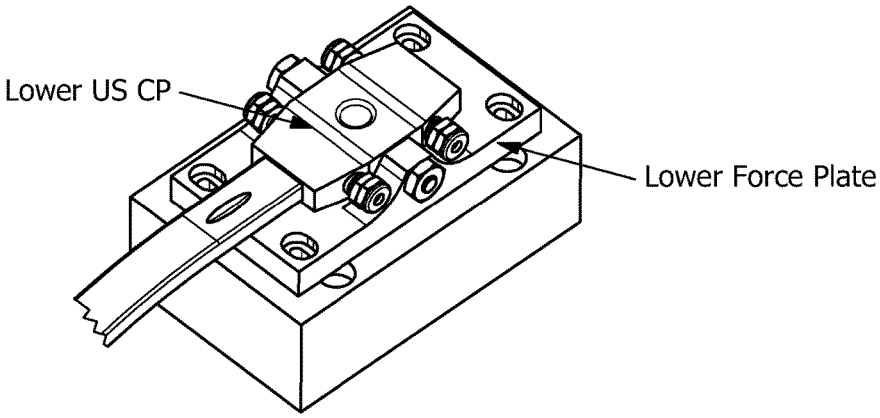
FIG. 8 depicts a set screw method of holding ultrasonic containment plate that is modified for an ultrasonic die.

With regard to holding the ultrasonic die segment, it is important to acoustically isolate the ultrasonic die segment from the surrounding die structure, while at the same time securing it in a fixed location so that it seamlessly merges into the overall die. Two approaches, which may be used alone or in combination with one another include: (i) low friction pads, wherein the pads include a Frelon coating or are made from a metallic bearing material such as bronze or cast iron; and (ii) a setscrew engagement. The first of these is illustrated in FIG. 7A. Although the surrounding die structure is shown as monolithic, it should be capable of some disassembly in order to insert the ultrasonic die as well as to provide access for the electrical (and possibly air) connections to the die insert. The low friction pads may be screw-in inserts and the dark gray circles on the die in FIG. 7B are the locations where the inserts on the opposite die wall (hidden in the view) touch the ultrasonic die. While the inserts may be sufficient to secure the die, a set screw method shown in FIG. 8, may be modified for this purpose.

The present invention has been described herein in reference to forming dies. A typical stamping/forming operation consists of the forming die, a blank holder and a punch, each of which may have large mass and dimensions (as noted earlier for a die). The concept of the present invention, i.e., an ultrasonically activated, embedded die insert may be applied to blank holders or punches, as well. By means of this invention it is possible to create ultrasonic vibrations in a critical segment or segments of a large die that would otherwise be impossible to ultrasonically excite to any significant vibration level, and in so doing, to reduce friction forces between sheet metal being formed and the forming die at one or more critical forming locations on the die.

While the present invention has been illustrated by the description of exemplary embodiments thereof, and while the embodiments have been described in certain detail, it is not the intention of the Applicant to restrict or in any way limit the scope of the appended claims to such detail. Additional advantages and modifications will readily appear to those skilled in the art. Therefore, the invention in its broader aspects is not limited to any of the specific details, representative devices and methods, and/or illustrative examples shown and described. Accordingly, departures may be made from such details without departing from the spirit or scope of the applicant's general inventive concept.

What is claimed:

1. A method for reducing areas of friction within a forming die, comprising:

(a) providing a forming die, wherein the forming die is adapted for use in sheet metal forming processes, and wherein the forming die includes surfaces that contact sheet metal being formed by the forming die;

(b) identifying at least one region of friction between the surfaces of the forming die and the sheet metal being formed by the forming die;

(c) designing a die segment corresponding to the at least one region of friction, wherein the designed die segment includes at least one ultrasonic transducer embedded completely within the die segment, and wherein the at least one ultrasonic transducer is surrounded on all sides by the material of the designed die segment;

(d) modifying the forming die to receive the designed die segment that includes the at least one ultrasonic transducer embedded completely within the designed die segment;

(e) installing the designed die segment in the forming die and acoustically isolating the designed die segment from the remainder of the forming die; and (f) creating a three-dimensional, ultrasonically vibrating, acoustically resonating die segment by energizing the at least one ultrasonic transducer to provide ultrasonic energy to the installed designed die segment, wherein providing ultrasonic energy to the installed designed die segment reduces friction between the surfaces of the forming die and the sheet metal being formed by the forming die.

2. The method of claim 1, wherein the sheet metal is used for manufacturing automobile parts.

3. The method of claim 1, wherein acoustically isolating the designed die segment from the remainder of the forming die further includes placing low friction pads between the designed die segment and the forming die.

4. A forming die for use with sheet metal processes, comprising:

(a) a forming die body, wherein the forming die body includes:

(i) surfaces that contact sheet metal being formed by the forming die; and (ii) at least one opening created in the forming die body at a region of friction between the surfaces of the forming die body that contact the sheet metal and the sheet metal itself;

(b) a designed die segment, wherein the designed die segment is inserted into the opening in forming die body, and wherein the designed die segment includes:

(i) at least one ultrasonic transducer embedded completely within the die segment, (ii) wherein the at least one ultrasonic transducer is surrounded on all sides by the material of the designed die segment for creating a three-dimensional, ultrasonically vibrating, acoustically resonating die segment and directing ultrasonic vibrations into the die segment; and (c) at least one vibration-isolating device positioned between the designed die segment and the forming die body, wherein the at least one vibration isolating device prevents ultrasonic vibrations from the designed die segment from entering the forming die body.

5. The forming die of claim 4, wherein the at least one vibration-isolating device is a low friction pad.

6. The forming die of claim 4, wherein the sheet metal is used for manufacturing automobile parts.

7. The forming die of claim 4, wherein the at least one ultrasonic transducer includes piezoceramics, and wherein the piezoceramics have been pre-compressed prior to the at least one ultrasonic transducer being embedded in the designed die segment.

8. The forming die of claim 7, wherein the piezoceramics have been pre-compressed with a compression bolt.

9. The forming die of claim 7, wherein the piezoceramics have been pre-compressed with tapered shims.

* * * * *